United States Patent [19]

Grant

[11] Patent Number: 4,849,052

[45] Date of Patent: Jul. 18, 1989

[54] BATCH DIGESTER MULTI-STAGE PULPING PROCESS

[75] Inventor: Ralph S. Grant, Beaverton, Oreg.

[73] Assignee: Beloit Corporation, Beloit, Wis.

[21] Appl. No.: 767,257

[22] Filed: Aug. 21, 1985

Related U.S. Application Data

[63] Continuation of Ser. No. 526,121, Aug. 24, 1983, abandoned.

[51] Int. Cl.[4] ..... D21C 7/10; D21C 7/12; D21C 7/14; D21C 11/00

[52] U.S. Cl. ..... 162/39; 162/45; 162/47; 162/59; 162/62

[58] Field of Search ..... 162/59, 60, 30.1, 42, 162/43, 44, 61, 62, 52, 19, 248, 249, 250, 47, 49

[56] References Cited

U.S. PATENT DOCUMENTS

| | | | |
|---|---|---|---|
| 1,934,957 | 11/1933 | Wells | 162/60 |
| 2,195,378 | 3/1940 | Dunbar | 162/60 |
| 2,671,727 | 3/1954 | Westcott et al. | 162/62 |
| 2,849,315 | 8/1958 | Haglund | 162/42 |
| 2,882,148 | 4/1959 | Rosenblad | 162/61 |
| 3,313,677 | 4/1967 | Carr | 162/59 |
| 3,445,328 | 5/1969 | Laakso | 162/19 |
| 4,236,961 | 12/1980 | Green | 162/61 |

*Primary Examiner*—Steve Alvo

*Attorney, Agent, or Firm*—Dirk J. Veneman; Raymond W. Campbell

[57] ABSTRACT

A multi-stage wood chip cooking process performed in a single digester in a batch type operation. The wood chips to be cooked are introduced into the digester and soaked with a warm black liquor to remove most of the air from the digester and the chips. This warm black liquor is thereafter displaced from the digester with a mixture of a first stage hot black liquor and hot white liquor, the proportionate amount of hot white liquor being relatively high. The temperature of the digester contents is then raised to a cooking temperature for a predetermined amount of time. The original cooking liquor is then displaced with a mixture of a second hot black liquor and hot white liquor, the proportiionate amount of hot white liquor in this second cooking liquor being less than in the first. Again, the temperature of the digester is raised to a cooking temperature and the cooking is carried out for a shorter period of time than in the first cooking stage. After the required number of cooks which may be preferably three but may be aas low as two or more than three, the cooking liquor is displaced from the digester with a liquor filtrate derived from pulp washing. Finally, the contents of the digester are emptied by applying gas under pressure to the interior of the digester.

1 Claim, 1 Drawing Sheet

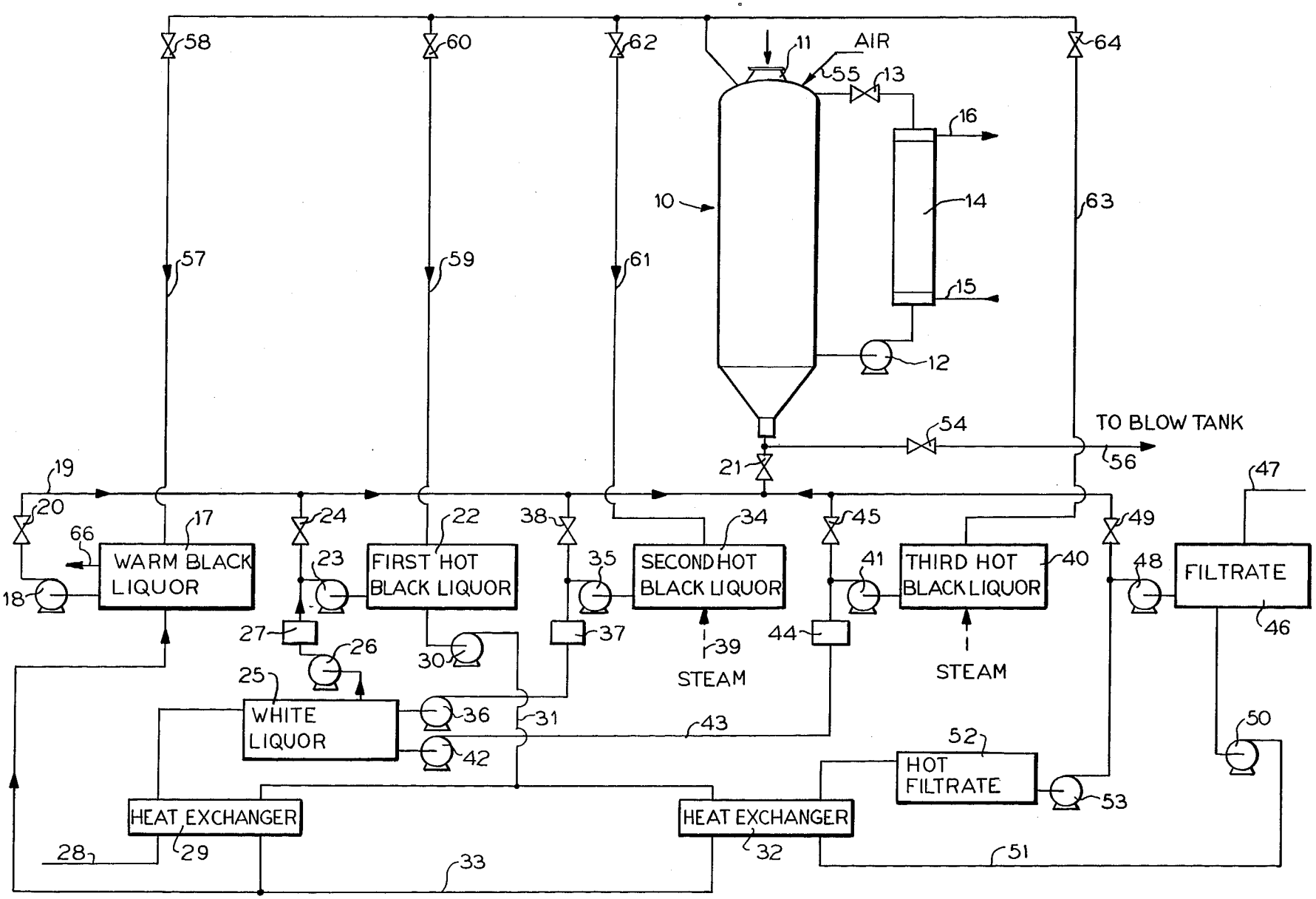
FILTRATE
TO BLOW TANK
THIRD HOT BLACK LIQUOR
STEAM
HOT FILTRATE
HEAT EXCHANGER
SECOND HOT BLACK LIQUOR
STEAM
FIRST HOT BLACK LIQUOR
WHITE LIQUOR
WARM BLACK LIQUOR
HEAT EXCHANGER
AIR

BATCH DIGESTER MULTI-STAGE PULPING PROCESS

This is a continuation, of application Ser. No. 526,121, filed Aug. 24, 1983, now abandoned.

BACKGROUND OF THE INVENTION

1. Field of the Invention

The present invention is in the field of chemical cooking of wood chips to produce pulp suitable for manufacture of paper and involves sequential use of various cooking liquors in the same digester for predetermined cooking times, to increase the efficiency of the process and to conserve energy.

2. Description of the Prior Art

There are numerous types of processes for batch digestion of wood chips in the manufacture of paper. The digestion usually takes place in a digester specifically built for that purpose, the digester being filled with the wood chips which are usually compacted therein. Hot solutions of sodium hydroxide alone or in admixture with sodium sulfide are then charged into the digester. The temperature of the digester can be controlled through the introduction of steam and after maintaining the chips in contact with the cooking liquor for a predetermined period of time, a blow valve in the digester can be opened to dump the contents into a blow tank.

There is a substantial amount of heat loss in carrying out the batch digestion process and while many systems have been suggested for minimizing this heat loss, none has been particularly effective. Some paper manufacturers have gone to continuous digesting processes in order to improve the efficiency of the cooking operation, but the equipment costs for a continuous digesting system are very high.

More recently, an improved type of batch process has been designed for overcoming these difficulties. In this new process, the wood chips are cooked in the digester and the hot black liquor which results is removed by displacement with a filtrate from the washing section. This filtrate is added to the bottom of the digester and pushes up the hot spent liquor through the chip column without a substantial intermingling of the two liquids. The displaced hot black liquor is then directed into a pressurized accumulator. The digester is then emptied by adding steam to the top of the digester which forces the pulp out through a blow valve into a blow tank. After the pulp has been blown from the digester, it is uniformly filled with chips.

Hot black liquor from the accumulator is pumped into the bottom of the digester where it heats the chips. In this stage, an excess of black liquor is employed, more than the capacity of the digester so that excess black liquor is discharged from the top of the digester and is transferred to a weak black liquor tank. Fresh white liquor is then used to displace the black liquor from the bottom of the digester and the resulting spent liquor is passed to a weak black liquor storage space. The contents of the digester are then heated with steam to the desired cooking temperatures and held there for the required cooking times. When the contents of the digester have reached the cooking temperature, the steam introduction stops. After cooking, the hot liquor is removed as in the originally described step, and the cycle starts over again. This type of process is described in Fagerlund Application Ser. No. 434,758, filed Oct. 18, 1982, now U.S. Pat. No. 4,578,149 and assigned to the assignee of the present application.

SUMMARY OF THE INVENTION

The present invention provides a multi-stage wood chip cooking process utilizing a single digester wherein the wood chips are introduced into the digester and soaked in a warm black liquor to remove most of the air from the digester and the chips. After a suitable soaking period, the warm black liquor is displaced from the digester with a mixture of a first hot black liquor and hot white liquor having a relatively high proportionate amount of white liquor. The temperature of the digester contents is raised to a cooking temperature usually by circulating the contents through a heat exchanger through which steam is added. After a suitable cooking period which will be the longest of the multi-stage process, the liquor is displaced from the digester with a mixture of a second hot black liquor and hot white liquor. This mixture has a proportionate amount of hot white liquor lower than in the first liquor. The temperature of the digester is again raised to a cooking temperature and after the chips have attained a predetermined degree of cooking, the liquor is displaced in the digester with a liquid filtrate derived from pulp washing. Finally, the contents of the digester are emptied by applying gas pressure to the interior of the digester.

Stated more generally, the present invention involves a multi-stage wood chip cooking process in which the chips are sequentially cooked in a digester in a series of cooks $C_1, C_2, C_3 \ldots C_n$. The cook $C_1$ is carried out with a liquid $L_1$ having a relatively high proportionate amount of white liquor and for a relatively long cooking time $T_1$. Cook $C_2$ is carried out with a liquor $L_2$ having a proportionate amount of white liquor less than $L_1$ and for a time shorter than $T_1$. Succeeding cooks are carried out through cook $C_n$ with a liquor $L_n$ at successively lower proportionate amounts of white liquor and successively shorter times. As few as two stages can be used, but three are preferred. More than three can be used where necessary or desirable.

In the case of a three-stage process for pulping softwood chips using the kraft process, the following conditions may apply. The total white liquor may typically constitute about 25% of the liquid capacity of the digester minus the volume of chips in the digester. The first cooking is carried out with an amount of white liquor comprising, 50 to 75% of the total white liquor for a period of 25 to 40 minutes, the second cooking is carried out with an amount of white liquor comprising 10 to 30% of the total for a period of 10 to 20 minutes, and the third cooking is carried out with an amount of white liquor comprising 5 to 20% of the total for a period of 5 to 15 minutes.

BRIEF DESCRIPTION OF THE DRAWING

The single Figure of the drawing illustrates schematically an installation for carrying out the multistage wood chip cooking process of the present invention.

DESCRIPTION OF THE PREFERRED EMBODIMENTS

In the attached Figure of the drawing, reference numeral 10 has been applied generally to a digester of the conventional type including a removable lid 11. The contents of the digester can be heated to a cooking temperature by pumping them through a pump 12 and a valve 13 through a heat exchanger 14 having a steam inlet line 15 and a steam condensate outlet line 16.

A warm liquor accumulator 17 stores black liquor at a relatively low temperature. This warm black liquor, at a temperature substantially below that required for cooking, is initially pumped by means of a pump 18 through a line 19 controlled by a valve 20 into the base of the digester 10 through an inlet valve 21.

The system also includes a first hot liquor accumulator 22 which contains the liquor for the first stage cook. This black liquor at a relatively high temperature is pumped out through a pump 23 and proceeds through a valve 24, through the valve 21 and into the base of the digester. A hot white liquor accumulator 25 serves as a storage vessel for the fresh hot white liquor which is pumped out of the accumulator 25 by means of a pump 26 through a flow regulator 27 and is thereupon combined with the discharge of the pump 23 from the first hot black liquor accumulator 22. The flow regulator 27 can be used to set the relative proportions between hot white liquor and hot black liquor in the first cooking step.

The hot white liquor is preheated after it is introduced through an inlet line 28 through a heat exchanger 29 before entering the hot white liquor accumulator 25. The heat exchange is accomplished by withdrawing a portion of the hot black liquor from the accumulator 22 through a pump 30 and a line 31. This hot black liquor is also used as the heat exchange liquid for a second heat exchanger 32 which will be described subsequently. The hot black liquor passing through the two heat exchangers 29 and 32 is removed as a warm but not hot liquid through a line 33 whereupon it is delivered to the warm liquor accumulator 17. Periodically, the warm black liquor from the accumulator 17 is discharged through a line 66 and passed to a black liquor evaporator.

A second hot liquor accumulator 34 is used to store the black liquor for the second cook. A pump 35 delivers a stream of the hot black liquor which is at a lower temperature than the hot black liquor in the accumulator 22 into combination with hot white liquor from the accumulator 25. The hot white liquor is delivered by means of a pump 36 through a flow regulator 37 where it is combined with the discharge of the pump 35, the combined discharge then passing through a valve 38 and into the base of the digester through the valve 21. The relative proportion of hot white liquor in this cook will be less than the proportion used in the first cook, and the cooing temperature will be less. Steam is optionally introduced into the second hot liquor accumulator 34 by means of a steam line 39.

A third hot liquor accumulator 40 containing hot black liquor for the third cook is provided with a pump 41 for the discharge of its contents. A pump 42 associated with the hot white liquor accumulator 25 delivers a metered amount of hot white liquor through a line 43 and a flow regulator 44 into admixture with the hot black liquor being pumped through the pump 41. The combined stream passes through a valve 45, and through the valve 21 into the base of the digester 10. The combined stream for the third cook has a lesser concentration of white liquor than the previous cooking liquors and is at a lower temperature.

A pulp washer filtrate recovered from another portion of the papermaking plant (not shown) is introduced into an accumulator 46 through a line 47. A pump 48 is provided to deliver the filtrate through a valve 49 and into the base of the digester through the valve 21. A portion of the filtrate in the accumulator 46 may be pumped by means of pump 50 through a line 51 and then through the heat exchanger 32 where it is passed in heat exchange relationship with the hot black liquor from the first hot liquor accumulator 22. This preheated filtrate is then directed to a hot filtrate accumulator 52. A pump 53 delivers the heated filtrate through the valve 49 and into the digester 10.

Finally, there is provided a discharge valve 54 for emptying the contents of the digester 10. For this purpose, air or other fluid is introduced through an inlet line 55 at the completion of the cook, whereupon valve 54 is opened and the contents of the digester are transferred to a blow tank or another receptacle through a discharge line 56.

The various cooking liquors are then returned to the accumulators upon completion of the individual stages of the cook. A line 57 and valve 58 are used to return a weak cooking liquor to the warm liquor accumulator 17. A line 59 and a valve 60 are used to deliver hot black liquor to the first hot liquor accumulator 22. Similarly, a line 61 and a valve 62 return liquor from the digester 10 to the second hot liquor accumulator 34. Material is recycled to the third hot liquor accumulator 40 by means of a line 63 and a valve 64.

The process of the present invention can be used with a modified kraft or soda pulping process. The multi-stage system preferably consists of three stages as shown in the drawing but may employ two stages or more than three. The multi-stage cook removes the non-cellulosic material from the wood chips in a manner so as to improve the pulp yield, improve the pulp quality as measured by the average molecule size, and improve the pulp brightness. Additionally, this new process permits pulps produced for further processing by bleaching to be more completely delignified and thus require a milder bleaching treatment using reduced quantities of bleach chemicals. A further advantage of this invention is that most of the pulp washing to remove spent cooking chemical and dissolved organic matter is done in the digester.

The conditions of time, temperature and active cooking chemical concentration can, within reasonable limits, be adjusted between the stages of cooking so as to optimize the desired pulp properties from the wood chips being used. This feature provides greater flexibility in the pulping operation.

The following description is given to show the overall process sequence.

The empty digester 10 is filled by removal of the lid 11 with wood chips. These chips may be compacted in order to increase the quantity of chips charged, and to provide a more uniform chip density. It is preferable that overly thick chips (more than 6 millimeters) be removed from the chips supply.

With the digester 10 closed, warm black liquor from the accumulator 17 is pumped by means of pump 18 through the line 19 to the valve 21 into the bottom of the digester which is substantially filled with chips. The digester is completely filled with this liquor and some excess is supplied. The excess leaves the digester by means of an extraction screen (not shown) located in the top dome of the digester 10. The excess liquor is returned to the warm liquor accumulator 17 through the line 57. This initial soaking with the warm liquor at a temperature considerably below cooking temperature serves to remove most of the air from the digester and the chips, warms the chips, and neutralizes some of the organic acids associated with the wood chips. The excess weak black liquor generated in the pulping and washing system is periodically discharged to the black liquor evaporators through the discharge line 66.

Hot black liquor from the first hot black liquor accumulator 22 and hot white liquor from the hot white liquor accumulator 25 are pumped together by means of pumps 23 and 26, respectively, through the valve 24 into the bottom of the digester which is now filled with warm black liquor. The displaced warm liquor leaves the digester via the extraction screen in the top dome of the digester and is returned to the warm black liquor accumulator 17 through the line 57.

Liquor from the first hot black liquor accumulator 22 is not only used for filling the digester 10 but is also used to preheat the fresh white liquor in the heat exchanger 29 and also to preheat the first portion of the washer filtrate in the heat exchanger 32. The black liquor leaving the two heat exchangers goes to the warm liquor accumulator 17 by means of the line 33.

The hot white liquor entering through the line 28 is also heated by the heat exchanger 29 before it arrives at the hot white liquor accumulator 25.

The temperature of the contents of the digester 10 filled with the mixture of hot black liquor from the first hot liquor accumulator 22 and the hot white liquor accumulator 25 is raised to the desired cooking temperature by circulating the contents of the digester through the valve 13 and heat exchanger 14 under the action of the pump 12. Forced circulation of liquor in the digester is preferred to insure uniform distribution of temperature and chemicals throughout the digester 10. In the case of a kraft process cooking for the three-stage sequence, the first cooking can take place with a liquor containing 50 to 75% of the total white liquor used and a cooking time of 25 to 40 minutes. No cooking operation in this multi-stage process requires as much as a 60 minute cook.

At the conclusion of the desired first stage cooking time, hot black liquor from the second hot liquor accumulator 34 and hot white liquor from the accumulator 25 are pumped together through pumps 35 and 36, respectively, into the bottom of the digester 10. Proportioning of the relative amounts is accomplished by the flow controller 37. This second cooking liquor contains a lower proportionate amount of white liquor and is used for a lesser cooking time than the first cook. Typically, the second cooking is carried out with a white liquor constituting 10 to 30% of the total for a period of 10 to 20 minutes.

The digester is brought up to cooking temperature by circulating the liquor through the heat exchanger 14.

Alternatively, steam can be added to the second hot liquor accumulator 34 through the steam line 39.

At the expiration of the desired second stage cooking time, hot black liquor from the third hot black liquor accumulator 40 and hot white liquor through the pump 42 and flow regulator 44 are combined and pumped together through valve 45 into the base of the digester 10. The displaced black liquor leaves the digester 10 and passes through line 61 and valve 62 into the second hot black liquor accumulator 34.

The temperature of the digester contents filled with the hot black liquor and hot white liquor is then raised to the desired cooking temperature by circulating through the heat exchanger 14. Alternatively, the heat exchanger can be eliminated and the steam can be injected directly into a circulating line whereby the contents of the digester are withdrawn from the top and pumped into the bottom by means of the pump 12. As another alternative, steam can be added to the third black liquor accumulator 40.

Typical conditions for the third cooking cycle include a white liquor fraction of 5 to 20% of the total and a cooking time of 5 to 15 minutes.

At the expiration of the desired third stage cooking time, filtrate from the pulp washing operation is pumped into the bottom of the digester. The displaced black liquor leaves the digester from the top and goes to the third hot black liquor accumulator 40 through the line 63 and valve 64.

The first portion of the filtrate is pumped from the accumulator 46 through a pump 50 into heat exchange relationship with the hot black liquor circulating through the heat exchanger 32. Preheating the first portion of the filtrate reduces the total steam required in the pulping system, permits the wash water added to the liquor system to be efficiently used by counter-current flow and maintains a low concentration of black liquor in the final cooking stages.

After the hot black liquor has been displaced from the third stage cook with the washer filtrate, compressed air is introduced through a line 55 into the top of the digester and the contents of the digester, pulp and washer filtrate are forced out of the bottom of the digester through a valve 54 into a suitable storage chest or blow tank by means of the line 56. The discharge of the chips from the digester by means of a curtain of air is more fully described in my co-pending application Ser. No. 402,636, filed July 28, 1982.

Typical cooking conditions for a three-stage process pulping softwood chips using the kraft process are given in the following table:

| Stage | % Total White Liquor | Total Cooking Time (min.) | Maximum Cooking Temp. °F. | Final Pulp Kappa Nr. | Final Black Liquor Solids, % |
|---|---|---|---|---|---|
| First | 69 | 50 | 340 | 100 | 25 |
| Second | 22 | 30 | 338 | 40 | 12 |
| Third | 9 | 25 | 335 | 25 | 4 |

The present invention permits the use of relatively short total cycle times and thus improves pulp production rates. Typical times for the various functions in a three-stage process according to the present invention are:

| Function | Time in Minutes |
|---|---|
| Chip Filling | 15 |
| Warm Liquor Fill | 20 |
| First Hot Liquor Fill | 15 |
| First Stage Cook | 35 |
| Second Hot Liquor Fill | 15 |
| Second Stage Cook | 15 |
| Third Hot Liquor Fill | 15 |
| Third Stage Cook | 10 |
| Hot Liquor Displacement | 20 |
| Blowing | 15 |
| Spare | 5 |
| Total Digester Cycle Time | 180 |

While the drawings illustrate a three-stage process and this is the preferred embodiment, the invention is more general than that. Basically, the invention involves a multi-stage wood chip cooking process in which the chips are sequentially cooked in a digester in a series of cooks $C_1$, $C_2$, $C_3$ . . . $C_n$. The cook $C_1$ is carried out with a liquor $L_1$ having a relatively high proportionate amount of white liquor and for a relatively long cooking time $T_1$. Cook $C_2$ is carried out with a liquor $L_2$ having a proportionate amount of white liquor less than $L_1$ and for a time shorter than $T_1$. Succeeding cooks through cook $C_n$ are carried out in successively lower proportionate amounts of white liquor and successively shorter times.

The total quantity of white liquor used in a digester is determined by (1) the degree of pulping or extent of delignification desired, (2) the quantity of wood chips charged on an oven dry basis, and (3) the concentration of the active cooking chemicals, sodium hydroxide and sodium sulphide, in the white liquor. For example, it is found that an active cooking chemical application, expressed as sodium oxide, of 15% on oven dry wood is required to achieve a properly delignified pulp. In a 6,000 cubic foot digester containing 60,000 pounds of bone dry wood there is a need for 15 percent of 60,000 or 9,000 pounds of active alkali. The volume of white liquor, found by test to contain 6.0 pounds of active alkali per cubic foot, required for the charge is then calculated to be 1,500 cubic feet.

In the above example, the entire quantity of white liquor is added to the charge in the initial filling operation in a conventional batch pulping system. With the new multi-stage process, assuming the same total white liquor usage, the application in a three-stage system could be as follows:

| Stage | White Liquor Charge | Percent of Total Charge |
|---|---|---|
| First | 1,000 cu. ft. | 66.7% |
| Second | 300 cu. ft. | 20.0% |
| Third | 200 cu. ft. | 13.3% |

-continued

| Stage | White Liquor Charge | Percent of Total Charge |
|---|---|---|
| Total | 1,500 cu. ft. | 100.0% |

It will be evident that various modifications can be made to the described embodiments without departing from the scope of the present invention.

I claim as my invention:

1. A multi-stage wood chip cooking process comprising the steps of:

introducing wood chips to be cooked into a digester, soaking the chips in said digester with a warm black liquor below cooking temperature to remove most of the air from said digester and said chips, displacing the warm black liquor from said digester with a mixture of a first hot black liquor and an amount of hot white liquor constituting from about 50 to 75% of the total white liquor, maintaining the contents of said digester at a first cooking temperature for a period of 25 to 40 minutes, displacing the liquor in said digester with a mixture of a second hot black liquor and fresh hot white liquor constituting from 10 to 30% of the total white liquor, maintaining the contents of said digester at a second cooking temperature lower than said first cooking temperature for a period of from 10 to 20 minutes, displacing the liquor in said digester with a mixture of a third hot black liquor and an amount of hot white liquor constituting 5 to 20% of the total white liquor, maintaining the contents of said digester at a third cooking temperature for a period of from 5 to 15 minutes, after the chips have attained a predetermined degree of cooking, displacing the liquor in said digester with a liquid filtrate derived from pulp washing, and emptying the contents of said digester by applying gas pressure to the interior of said digester.

* * * * *